US011457308B2

(12) United States Patent
Secall et al.

(10) Patent No.: US 11,457,308 B2
(45) Date of Patent: Sep. 27, 2022

(54) MICROPHONE DEVICE TO PROVIDE AUDIO WITH SPATIAL CONTEXT

(71) Applicant: Sonova AG

(72) Inventors: Marc Secall, Constantine (CH); Benjamin Heldner, Murten (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 15/734,561

(22) PCT Filed: Jun. 7, 2018

(86) PCT No.: PCT/EP2018/065094
§ 371 (c)(1),
(2) Date: Dec. 3, 2020

(87) PCT Pub. No.: WO2019/233588
PCT Pub. Date: Dec. 12, 2019

(65) Prior Publication Data

US 2021/0235189 A1 Jul. 29, 2021

(51) Int. Cl.
*H04R 3/00* (2006.01)
*H04S 1/00* (2006.01)
*H04S 7/00* (2006.01)

(52) U.S. Cl.
CPC ..... *H04R 3/005* (2013.01); *H04S 1/002* (2013.01); *H04S 7/302* (2013.01); *H04R 2203/12* (2013.01); *H04S 2420/01* (2013.01)

(58) Field of Classification Search
CPC ..... H04R 3/005; H04R 2203/12; H04S 1/002; H04S 7/302; H04S 2420/01
USPC ..... 381/1, 2, 56, 58, 80, 91, 92, 122
See application file for complete search history.

(56) References Cited

U.S. PATENT DOCUMENTS 7,720,212 B1 5/2010 Jouppi et al.
8,314,829 B2 * 11/2012 Cutler ..... H04R 3/005 381/92
8,666,047 B2 3/2014 Rambo
8,737,648 B2 5/2014 Chen et al.
9,706,292 B2 7/2017 Duraiswami et al.
(Continued)

FOREIGN PATENT DOCUMENTS

EP 2 840 807 A1 2/2015
EP 1 879 426 A2 1/2018
(Continued)

OTHER PUBLICATIONS

European Patent Office, International Searching Authority, International Search Report for PCT/EP2018/065094, dated Feb. 11, 2019, Rijswijk, Netherlands.

*Primary Examiner* — William A Jerez Lora
(74) *Attorney, Agent, or Firm* — Pearne & Gordon LLP

(57) ABSTRACT

The disclosed technology generally relates to a microphone device configured to receive sound from different beams, where each beam has a different spatial orientation and is configured to receive sound from different directions. The microphone device is also configured to process the received sound using a generic or specific head related transfer function (HRTF) to generate processed audio and transmit the processed audio to hearing devices worn by a hearing-impaired user. Additionally, the microphone device can use a reference line and/or reference point when processing the received audio.

25 Claims, 6 Drawing Sheets

(56) References Cited

U.S. PATENT DOCUMENTS

| | | | | |
|---|---|---|---|---|
| 2006/0104458 | A1* | 5/2006 | Kenoyer | H04R 3/005 381/92 |
| 2012/0262536 | A1 | 10/2012 | Chen et al. | |
| 2015/0049892 | A1* | 2/2015 | Petersen | H04R 25/554 381/315 |
| 2015/0249898 | A1 | 9/2015 | Harman | |
| 2016/0275960 | A1 | 9/2016 | Lin et al. | |
| 2016/0360326 | A1 | 12/2016 | Bergmann et al. | |
| 2017/0026740 | A1 | 1/2017 | Kirsch et al. | |
| 2018/0336902 | A1* | 11/2018 | Cartwright | G06F 16/61 |

FOREIGN PATENT DOCUMENTS

| | | | |
|---|---|---|---|
| WO | 2008098590 | A1 | 8/2008 |
| WO | 2011015675 | A2 | 2/2011 |
| WO | 2016116160 | A1 | 7/2016 |
| WO | 2016131064 | A1 | 8/2016 |
| WO | 2017005981 | A1 | 1/2017 |

* cited by examiner

MICROPHONE DEVICE TO PROVIDE AUDIO WITH SPATIAL CONTEXT

TECHNICAL FIELD

The disclosed technology generally relates to a microphone device configured to: receive sound from different sound receiving beams (where each beam has a different spatial orientation), process the received sound using a Head Related Transfer Function (HRTF), and transmit the processed sound to hearing devices worn by a hearing-impaired user.

BACKGROUND

It is challenging for a hearing-impaired person to understand speech in a room with multiple speakers. When only one speaker is present, the speaker may use a single wireless microphone to provide audio to a hearing-impaired person because the speaker frequently wears the microphone close to his or her mouth enabling a good signal-to-noise ratio (SNR) (e.g., a clip-on microphone or handheld microphone). In contrast, when multiple speakers are present, a single microphone is not sufficient because the multiple speakers generate audio from multiple directions simultaneously or sporadically. This simultaneously or sporadically sound generation can decrease SNR or degrade speech intelligibility, especially for a hearing-impaired person.

In an environment with multiple speakers, one solution is for every speaker to hold or wear a wireless microphone; however, this solution has drawbacks. First, providing many wireless microphones can result in an excessive effort for the hearing-impaired person: specifically, a hearing-impaired person would need to provide each person with a wireless microphone and this would draw unwanted attention and negative stigma to the hearing-impaired person. Second, if a limited number of microphones are available, it is not possible for each speaker to have a microphone, and this results in multiple speakers per microphone, which can cause speech intelligibility issues. Moreover, the hearing-impaired person prefers to conceal his or her handicap and consequently does not want to ask each speaker to wear a microphone.

Another solution for providing audio to a hearing-impaired person in a multiple speaker environment is a table microphone. Table microphones receive sound from a sound environment and transmit processed audio to a hearing device as a monaural signal. However, a monaural signal does not include spatial information in the audio signal, thus the hearing-impaired individual cannot spatially segregate sound when listening to a monaural signal, which results in reduced speech understanding.

Here are a few other systems that improve speech intelligibility or SNR. US 2010/0324890 A1 relates to an audio conferencing system, wherein an audio stream is selected from a plurality of audio streams provided by a plurality of microphones, wherein each audio stream is awarded a certain score representative of its usefulness for the listener, and wherein the stream having the highest score is selected. EP 1 423 988 B2 relates to beamforming using an oversampled filter bank, wherein the direction of the beam is selected according to voice activity detection (VAD) and/or signal-to-noise ratio (SNR). US 2008/0262849A1 relates to a voice control system comprising an acoustic beamformer that is steered according to the position of a speaker, which is determined according to a control signal emitted by a mobile device utilized. WO 97/48252A1 relates to a video conferencing system wherein the direction of arrival of a speech signal is estimated to direct a video camera towards the respective speaker. WO 2005/048648A2 relates to a hearing instrument comprising a beam former utilizing audio signals from a first microphone embedded in a first structure and a second microphone embedded in a second structure, wherein the first and second structure are freely movable relative to each other.

Also, PCT Patent Application No. WO2017/174136, titled "Hearing Assistance System," discloses a table microphone that receives sound in a conference room. The table microphone has three microphones and a beam former unit configured to generate an acoustical beam and receive sound in the acoustical beam, which is incorporated by reference in this disclosure for its entirety. The application also discloses an algorithm for selecting a beam or adding sound from each beam based on a time-variable weighting.

However, even though these patents and patent applications disclose technology that improves speech intelligibility, microphone and hearing technology can still be improved to provide better processed audio, especially for hearing-impaired people.

SUMMARY

This summary provides concepts of the disclosed technology in a simplified form that are further described below in the Detailed Description. The disclosed technology can include a microphone device comprising: a first and second microphone configured to individually or in combination form a sound receiving beam or beams; a processor electronically coupled to the first and second microphones, the processor configured to apply a head related transfer function (HRTF) to received sound at the sound receiving beam or beams based on an orientation of the sound receiving beam or beams based on a reference point to generate a multichannel output audio signal; and a transmitter configured to transmit the multichannel output audio signal generated by the processor, wherein the reference point is associated with a location on the microphone device. The HRTF can be a generic HRTF or a specific HRTF, wherein the specific HRTF is associated with a head of a wearer of the hearing devices.

In some implementations, the processor weighs the received sound from a front, left, or right side of the virtual listener more than other received sound from the back of the virtual listener on the microphone device.

In some implementations, the microphone device transmits the multichannel output audio signal to hearing devices, wherein a wearer of the hearing devices positioned the reference point relative to the wearer, and wherein the reference point is associated with a virtual listener. In some implementations, the multichannel output audio signal is a stereo signal. For example, a stereo audio signal with a left and right channel for the left hearing device and the right hearing device.

The microphone device can also include a third microphone configured to individually or in combination with the first and second microphone form the beam or beams. The first, second, and third microphones can have an equal spacing distance between each other. The first, second, and third microphones can also have different spacing distances.

In some implementations, the reference point is a physical mark on the microphone device. The reference point can be a physical mark on the microphone device located on a side of the microphone device, wherein the physical mark is visible. The reference point can also be a virtual mark associated with a location on the microphone device.

In some implementations, the first and second microphones are directional microphones. Each directional microphone can form a sound receiving beam or sound receiving beams. The first and second microphones can also be combined with a processor to form the sound receiving beam or beams, e.g., by using beamforming techniques.

In some implementations, the microphone device can be configured to determine a location of the reference point based on an own voice detection signal received from a hearing device and one of the sound receiving beams receiving sound. The microphone device can also be configured to determine the reference point based on receiving characteristics of a wearer's own voice from a hearing device and configured to use those characteristics to determine whether the wearer's own voice is detected at one of the sound receiving beam or beams. In other implementations, the microphone device is configured to determine a location of the reference point based on a voice fingerprint of a user's own voice that is stored on the microphone device. For example, the microphone device could have downloaded a voice fingerprint or received it from a user's mobile device. The microphone device can also be configured to determine a location of the reference point based on receiving an own voice detection signal received from a hearing device, receiving sound at one of the sound receiving beams, generating a voice fingerprint of the wearer's own voice from the receiving sound at one of the sound receiving beams, and determining that user's voice is received in one of the sound receiving beams based on the generated voice fingerprint.

The disclosed technology also includes a method. The method for using a microphone device comprises: forming, by the microphone device, sound receiving beams, wherein each of the sound receiving beams is configured to receive sound arriving from a different direction; processing, by the microphone device, received sound from one of the sound receiving beams based on a HRTF and a reference point to generate a multichannel output audio signal; and transmitting the multichannel output audio signal to hearing devices. In some implementations of the method, a wearer of the hearing devices positioned the reference point relative to the wearer. The HRTF can be a generic HRTF or a specific HRTF, wherein the specific HRTF is associated with a head of a wearer of the hearing devices.

In some implementations, processing the received sound can further comprise determining a location of the reference point based on receiving an own voice detection signal from one of the hearing devices and the microphone device detecting sound in one of the sound receiving beams. In other implementations, processing of the received sound can further comprise determining a location of the reference point based on receiving detected characteristics of wearer's own voice from one of the hearing devices and using those detected characteristics to determine whether a wearer's own voice is detected at one of the sound receiving beams. In other implementations, processing the received sound can further comprise: determining a location of the reference point based on a stored voice fingerprint for the wearer's own voice.

The method can also be stored in a computer-readable medium. For example, the microphone device can have a memory storing part or all of the operations of the method.

BRIEF DESCRIPTION OF THE DRAWINGS

The accompanying figures are some implementations of the disclosed technology.

Figure 1:
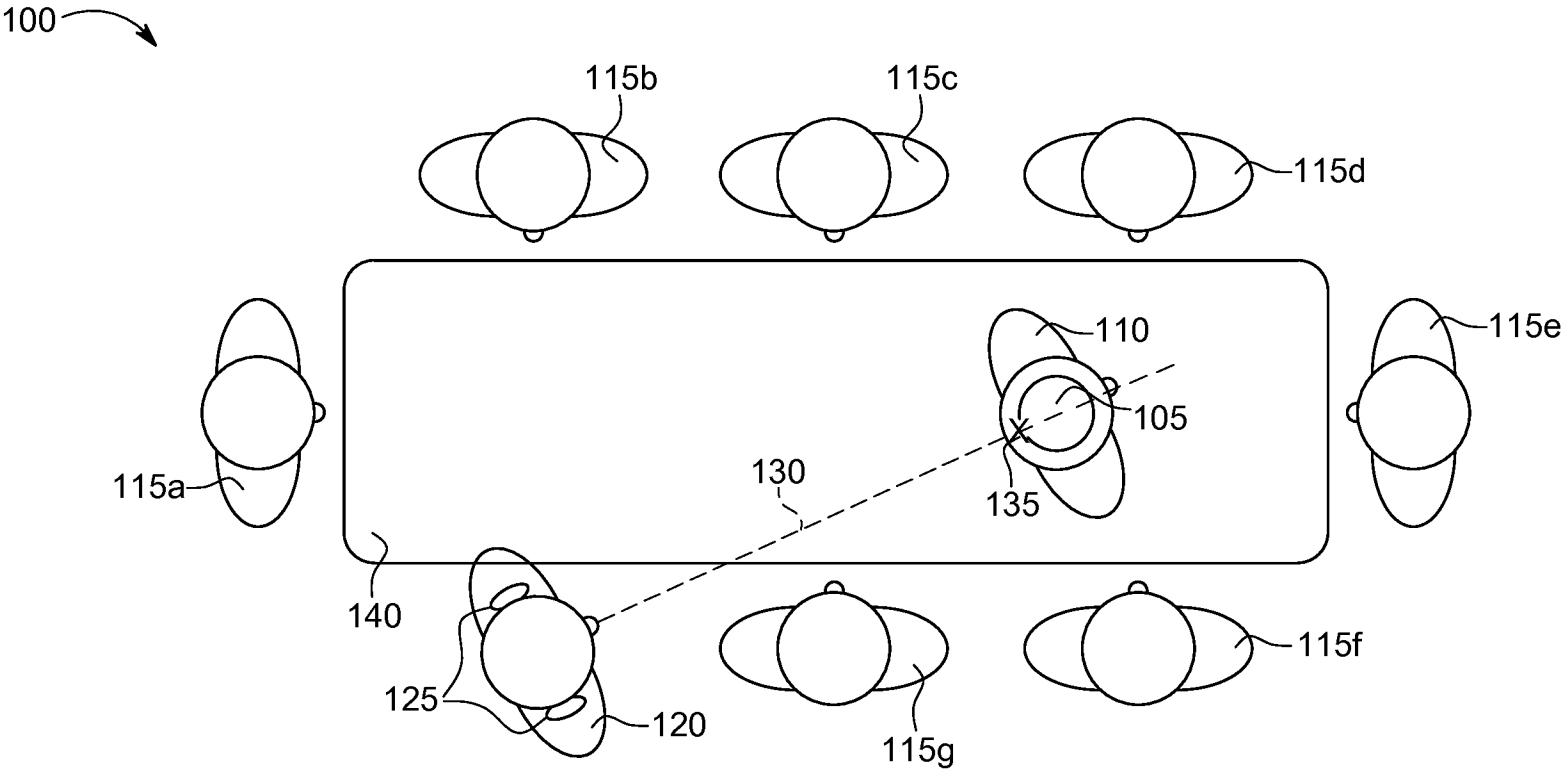
FIG. 1 illustrates a listening environment in accordance with some implementations of the disclosed technology.

The figures are not drawn to scale and have various viewpoints and perspectives. Some components or operations shown in the figures may be separated into different blocks or combined into a single block for the purposes of discussion. Although the disclosed technology is amenable to various modifications and alternative forms, specific implementations have been shown in the figures and are described in detail below. The disclosed technology is intended to cover all modifications, equivalents, and alternatives falling within the scope of the appended claims.

DETAILED DESCRIPTION

The disclosed technology relates to a microphone device configured to: receive sound from or through different sound receiving beams (where each beam has a different spatial orientation), process the received sound using a generic or specific HRTF, and transmit the processed sound to hearing devices worn by a hearing-impaired user (e.g., as a stereo signal). To receive and process the sound, the microphone device can form multiple beams. The microphone device also can determine the position of these beams based on a reference point (described in more detail in FIGS. 1 and 2A-2C). With the reference point and the determined position of the beams, the microphone device can process sound with a generic or specific HRTF such that the sound includes spatial context. If hearing devices receive the processed sound from the microphone device, the wearer of the hearing devices hears the sound with spatial context. The disclosed technology is described in more detail in the following paragraphs.

Regarding beams, the microphone device is configured to form multiple beams where each beam is configured to receive sound from a different direction. Beams can be generated with directional microphones or with beamforming. Beamforming is a signal processing method used to direct signal reception (e.g., signal energy) in a chosen angular direction or directions. A processor and microphones can be configured to form beams and perform beamforming operations based on amplitude, phase delay, time delay, or other waves properties. The beams can also be referred to as "sound receiving beams" because the beams receive audio or sound.

As an example, the microphone device can have three microphones and a processor configured to form 6 beams. A first beam can be configured to receive sound from 0 to 60 degrees (e.g., on a circle), a second beam can be configured to receive sound from 61-120 degrees, third beam configured to receive sound from 121-180 degrees, a fourth beam configured to receive sound from 181-240 degrees, a fifth beam configured to receive sound from 241-300, and a sixth beam configured to receive sound from 301-360 degrees.

Also, the microphone device can generate beams such that there is no "dead space" between the beams. For example, the microphone device can generate beams that partially overlap. The amount of partial overlap can be adjusted by the processor. For example, a first beam can be configured to receive sound from 121-180 degrees and a second beam can be configured to receive sound from 170 degrees to 245 degrees, which means the first and second beams overlap from 170-180 degrees. If the beams overlap partially, the processor is configured to process the arriving sound in the overlapping beams based on defined overlapping amounts.

When processing the received sound from beams, the microphone device can weigh beam angles to process signals. Weighing generally means the microphone device mixes received sound from each beam with specific weights, which can be fixed or dependent on criteria such as beam signal energy or beam SNR ratio. The microphone device can use weighing to prioritize sound coming from the left, right, or front side of a user as compared to the user's own voice. If the microphone device weighs sound based on beam signal energy, the microphone device weighs beams with a high signal energy more than those having a low signal energy. Alternatively, the microphone device can weigh signals from one beam with a high SNR more than signals from another beam with a low SNR based on a threshold SNR. The SNR threshold can be defined at an SNR where a user can understand speech, e.g., below the threshold SNR it is difficult or not possible for a user to understand speech because the SNR is too poor. The SNR threshold can be set to a default value or it can set to a user's individual preferences such as a minimum SNR to understand speech based on the user's hearing capability.

Regarding the reference point, the microphone device can use a reference point to weigh beams or process received sound. A reference point is a known position on the microphone device that can be used to orient the microphone device relative to a user or hearing device. The reference point can be a physical mark on the microphone device, e.g., an "X" on the side of the microphone device that is visible. The physical mark can be letters or numbers other than "X" or a shape. In some implementations, the microphone device has an instruction manual (paper or electronic), where a user of the microphone device can learn about the mark and determine how to calibrate or position the microphone with the mark. Alternatively, the microphone device can store instructions and communicate the instructions to a user with audio (e.g., with a speaker). In some implementations, a user of the microphone device aligns the reference point to face him or her. Because the reference point has a known location on the microphone device and the microphone device generates beams with a known orientation, the microphone device can determine the location of a beam relative to the reference point. As such the microphone can receive sound at beams with known orientations and spatially filter received sound.

In some implementations, the reference point is a virtual mark such as an electric field, a magnetic field, or electromagnetic field in a particular location of the microphone device (e.g., left side, right side, center of mass, side of the microphone device). The virtual mark can be light from a light emitting diode (LED) or light generating device. In yet other implementations, the virtual mark can be acoustical such as an ultrasound wave detectable by the hearing device. In some implementations, the microphone device can determine a virtual mark location by using multiple antennas on the microphone device or packet angle of arrival information from a hearing device.

The reference point can have a location on a coordinate system (e.g., x and y, radius and/or angle) or the reference point can be the center of a coordinate system for the microphone device. For example, the microphone device can translate from beam angles to an azimuth angle of the HRTF based on the reference point, including a linear or non-linear function translation.

In some implementations, the microphone device can locally store features of a user's own voice and use those stored features at a later time to determine a location of the reference point. For example, the microphone device can receive a user voice fingerprint and store it in memory. The microphone device could have received the voice fingerprint directly from the user (e.g., from a user's hearing device, from a user's mobile phone, or during calibration for the microphone device) or from a computer device over an internet connection. Using the stored voice fingerprint, the microphone device can detect when a user is speaking and at which beam the user's voice is received. The beam that detects a user's voice can be referred to as the assumed location of the user. Here, the microphone device can determine the reference point by projecting a reference line from the assumed location of the user to microphone device such that the reference point is the point where the reference line contacts the microphone device. See FIG. 1 and FIG. 2C for more details.

Alternatively, the microphone device can determine a location of the reference point based on receiving an own voice detection signal from a hearing device while simultaneously receiving (or recently receiving sound) from a beam. Here, the microphone device can infer that a user is located in or near a particular beam that is receiving sound because the microphone device is simultaneously receiving or (recently receiving) a signal from the hearing device while the microphone device is also receiving (or recently received) sound at a beam. Here, the microphone device can determine the reference point by projecting a reference line from the assumed position of the user to microphone device such that the reference point is the point where the reference line contacts the microphone device. See FIG. 1 and FIG. 2C for more details.

In some implementations, the disclosed technology solves at least one technical problem with one or more technical solutions. One technical solution is that the microphone device can transmit processed audio, where the audio is processed such that spatial context is included in an output audio signal so that a listener hears the audio as if the listener is in the same position as the microphone device. Having audio with spatial context (also referred to as "spatial cues") assists a listener in identifying the current speaker in a group of people without additional information (e.g., visual information). Also, because the microphone device at least partially or completely incorporates spatial context, the microphone device degrades speech intelligibility less than a system that does not consider spatial context, as the spatial context enables auditory stream segregation and thus reduces the detrimental effect on speech understanding of the unwanted speakers.

Also, the microphone device applies the HRTF, which can be a power intensive operation, instead of the hearing device applying the HRTF. This is beneficial because the hearing device has a battery with limited power compared to larger devices (e.g., microphone device).

FIG. 1 is a listening environment 100. The listening environment 100 includes a microphone device 105, a virtual listener 110 (e.g., a theoretical person who is superimposed on the microphone device 105), speakers 115*a-g*, and a listener 120 with hearing devices 125. The listener 120 can also be referred to as a "user" or "wearer" or "wearer of the hearing devices 125" or "hearing-impaired listener" if the listener has hearing problems because the listener is wearing the hearing devices 125. The microphone device 105 can be placed on a table 140, e.g., in a conference room. Further detail regarding the microphone device 105 is disclosed in FIGS. 2A-C, FIG. 3, and FIG. 4.

The microphone device 105 receives sound from the listening environment 100, including speech from one or all of the speakers 115*a-g*, processes the sound (e.g., amplifies sound, filters it, modifies the SNR, and/or applies an HRTF), generates processed audio, and transmits the processed audio to the hearing devices 125. In some implementations, the transmitted audio is transmitted as a multichannel signal (e.g., stereo signal), where one part of the stream is intended for a first hearing device (e.g., the left hearing device) and another part of the stream is intended for a second hearing device (e.g., the right hearing device). The multichannel audio signal can include different audio channels configured to provide Dolby Surround, Dolby Digital 5.1, Dolby Digital 6.1, Dolby Digital 7.1, or other multichannel audio signals. Also, the multichannel signal can include channels for different orientations (e.g., front, side, back, front-left, front-ride, or orientations from 0 to 360 degrees). For hearing devices in some implementations, it is preferred to transmit a stereo signal.

In some implementations, each of the hearing devices 125 is configured to wirelessly communicate with the microphone device 105. For example, each hearing device can have an antenna and a processor, where the processor is configured to execute a wireless communication protocol. The processor can include special-purpose hardware such as application specific integrated circuits (ASICs), programmable logic devices (PLDs), field-programmable gate arrays (FPGAs), programmable circuitry (e.g., one or more microprocessors microcontrollers), Digital Signal Processor (DSP), appropriately programmed with software and/or computer code, or a combination of special purpose hardware and programmable circuitry. In some implementations, the hearing device can have multiple processors, where the multiple processors can be physically coupled to the hearing device 125 and configured to communicate with each other. In some implementations, the hearing devices 125 can be binaural hearing devices, which means that these devices can communicate with each other wirelessly.

The hearing device 125 is a device that provides audio to a user wearing the device. Some example hearing devices include hearing aids, headphones, earphones, assistive listening devices, or any combination thereof; and hearing devices include both prescription devices and non-prescription devices configured to be worn on a human head. A hearing aid is a device that provides amplification, attenuation, or frequency modification of audio signals to compensate for hearing loss or attenuation functionalities; some example hearing aids include a Behind-the-Ear (BTE), Receiver-in-the-Canal RIC, In-the-Ear (ITE), Completely-in-the-Canal (CIC), Invisible-in-the-Canal (IIC) hearing aids or a cochlear implant (where a cochlear implant includes a device part and an implant part).

In some implementations, the hearing devices are configured to detect a user's own voice, where the user is wearing the hearing devices. Although there are several methods or systems for detecting a user's own voice in a hearing device, one system to detect own voice is a hearing device that includes a first microphone adapted to be worn about the ear of the person, a second microphone adapted to be worn about the ear canal or ear of the person and at a different location than the first microphone. The hearing device can be adapted to process signals from the first microphone and second microphone to detect a user's own voice.

As illustrated in FIG. 1, the microphone device 105 includes a reference point 135. The reference point 135 is a location on the microphone device 105 used to orient the location of the microphone device 105 relative to the listener 120 and/or relative to beams formed by the microphone device (see FIGS. 2A-C for more detail on beams). The reference point 135 can be a physical mark on the microphone device, e.g., an "X" on the side of the microphone device that is visible. The physical mark can be letters or numbers other than "X" or a shape. In some implementations, the microphone device has an instruction manual (paper or electronic), where a user of the microphone device can learn about the physical mark and determine how to calibrate or position the microphone with the physical mark. Alternatively, the microphone device can store instructions and communicate the instructions to a user with audio (e.g., with a speaker) or via wireless communication (e.g., over a mobile application in communication with the microphone device). The reference point 135 can be located on the side of the microphone device 105 or other location of the microphone device 105 that is visible or accessible.

In some implementations, the reference point 135 is a virtual mark such as an electric field, a magnetic field, or electromagnetic field in a particular location of the microphone device (e.g., left side, right side, center of mass, side of the microphone device). The virtual mark can be light from a light emitting diode (LED) or light generating device. In yet other implementations, the virtual mark can be acoustical such as an ultrasound wave detectable by the hearing device.

In some implementations, the microphone device can compute a location of the virtual mark, which can be used to determine the location of the microphone device relative to a wearer of the hearing devices. To compute the virtual mark location, the microphone device can receive packets from a hearing device, where the packets are transmitted for direction finding. The microphone device can receive these direction-finding packets at an antenna array in the microphone device. The microphone device can then use the received packets to calculate the phase difference in the radio signal received using different elements of the antenna array (e.g., switching antennas), which in turn can be used to estimate the angle of arrival. Based on the angle of arrival, the microphone device can determine the location of the virtual mark (e.g., the angle of arrival can be associated with a vector that points to the wearer of the hearing devices, the virtual mark can be a point on the vector and on the microphone device). In other implementations, the microphone device can transmit packets that include angle of departure information. The hearing device can receive these packets and then send a response packet or packets to the hearing device. The microphone device can use the response packets and angle of transmission information to determine the location of the virtual mark. The angle of arrival or angle of departure may also be based on propagation delays.

The virtual listener 110 is generally a person that is located (virtually) where the microphone device 105 is located in an orientation associated with the reference point 135. The virtual listener 110 can also be referred to as a "superimposed" listener because the virtual listener 110 is virtually located on the microphone device in an orientation. For example, the reference point 135 is located at the back of the virtual listener 110, so the microphone device 105 can prioritize sounds coming from the front of the reference point 135 versus the back of the reference point 135 of the microphone device 105. For example, the microphone device 105 can prioritize sounds coming from the front, right, or left of the reference point 135 and deprioritize sounds coming from the back of the reference point 135 because the user is a hearing impaired individual and it is preferable that the user not prioritize his or her own voice (e.g., sounds from the back) and prioritize sounds coming from the front or side (e.g., other speakers in front of the virtual listener or to the side of the virtual listener). The microphone device 105 can apply a simple weighting scheme to prioritizes or deprioritize sound from the front and/or back. A similar weighting scheme can be applied to a sound from the left or right or one side versus another side.

Additionally, the reference point 135 is associated with a reference line 130. Associated generally means there is a mathematical relationship between the reference point 135 and the reference line 130, for example, the reference point 135 is a point on the reference line 130. The reference line 130 is a line drawn from the listener 120 through or to the reference point 135 on the microphone device 105 (e.g., as shown in FIG. 1). Because the listener 120 positioned the microphone device such that the listener 120 is looking at reference point 135, the microphone device can determine the orientation of the listener 120 and beams generated by the microphone device 105. For example, a wearer of the hearing devices 125 positioned the reference point 135 relative to the wearer by placing the microphone device 105 on a table and using the reference point 135 as a mark for guidance.

In some implementations, the hearing devices 125 are configured to wirelessly communicate with the microphone device 105. For example, the hearing devices 125 can use Bluetooth™, Bluetooth LE™, Wi-Fi™, 802.11 Institute of Electrical Electronics Engineers (IEEE) wireless communication standards, or a proprietary wireless communication standard to communicate with the microphone device 105. In some implementations, the hearing devices 125 can pair with the microphone device 105 or use other encryption technology to communicate with the microphone device 105 securely.

Figure 2A:
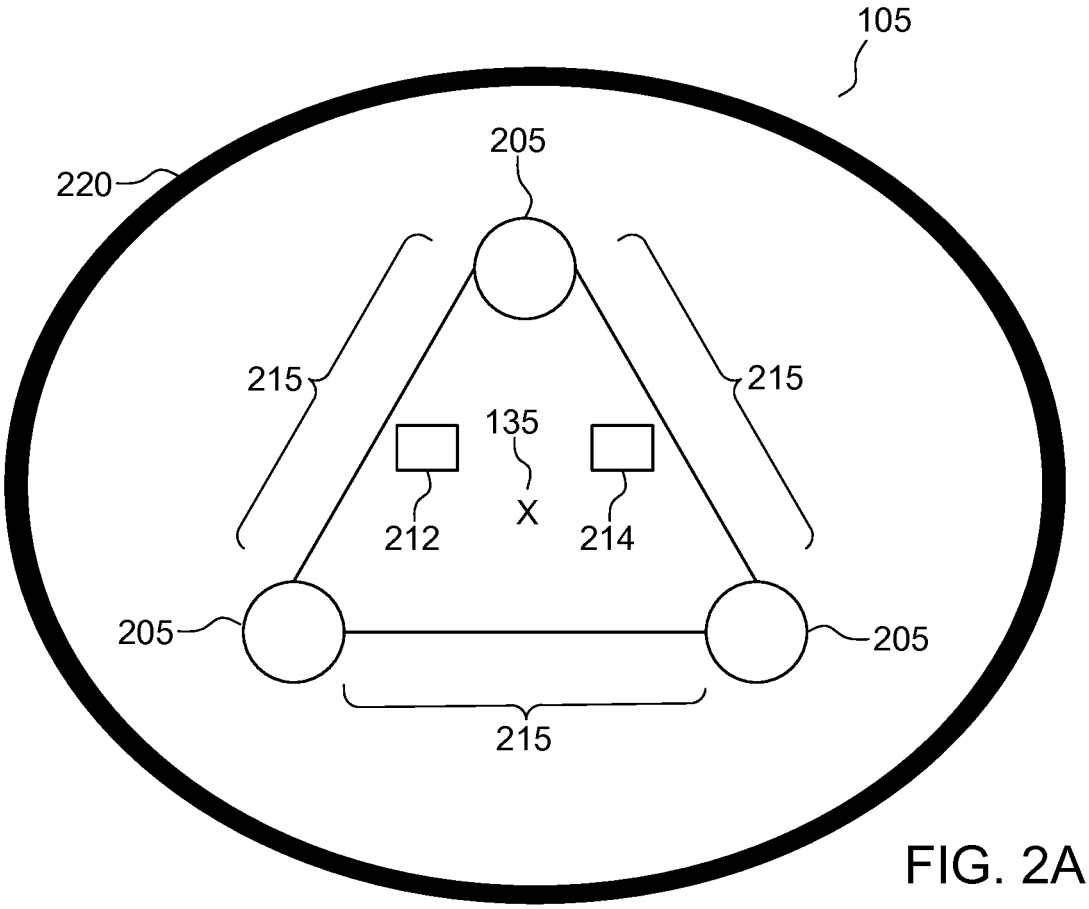
FIG. 2A illustrates a microphone device configured to spatially filter sound and transmit processed audio to hearing devices in accordance with some implementations of the disclosed technology.

Moving to FIG. 2A, FIG. 2A illustrates the microphone device 105 configured to spatially filter sound and transmit processed audio to a hearing device or hearing devices. In some implementations, the microphone device 105 has at least two microphones 205 or at least three microphones 205. For example, the number of microphones can be 2, 3, 4, 5, 6, 7, 8, 9, 10, or more to form more beams or have beams with finer resolutions, where resolution refers to angle of sound where the beam can receive sound (e.g., obtuse angles provide less resolution than acute angles).

As shown in FIG. 2A, the microphone device 105 has three microphones 205 and each microphone is spaced apart from the microphone by a spacing distance 215. The spacing distance 215 can be the same or vary between microphones 205. For example, the number of microphones and the spacing distance 215 can be modified to adjust beams formed by the microphone device 105. The spacing distance 215 can be increased or decreased to adjust parameters of the microphone device 105 related to the beams. For example, the spacing can partially determine a beam shape and frequency response. In one implementation, the spacing distance 215 can be equal for all microphones such that the microphones form an equilateral triangle and there are 6 beams, wherein each spacing distance is equal. This implementation can be beneficial for a conference with speakers sitting at a table because each beam receives audio from each speaker and there is a well-balanced spatial division between the beams because each speaker is sitting in front of a beam.

The microphone device 105 can generate directional beams, e.g., with a directional microphones. A single microphone can be a directional microphone or can use processing techniques with another microphone to form a beam. Alternatively, a processor and microphones can be configured to form beams based beamforming techniques. For example, the processor can time delay or phase delay or phase shift for parts of signals from a microphone array such that only sound from an area is received (e.g., 0 to 60 degrees or only sound from the front of a microphone such as 0 to 180 degrees). The microphones 205 can also be referred to as a "first", "second", and "third" microphone, and so on, where each microphone can form its own beam (e.g., a directional microphone) or the microphone can communicate with another microphone or microphones and the processor to execute beam forming techniques to form beams. For example, the microphone device can have a first and second microphone configured to individually or in combination with a processor form a beam or beams.

The microphone device 105 also includes a processor 212 and a transmitter 214. The processor 212 can be used in combination with the microphones 205 to form beams. The transmitter 214 is electronically coupled to the processor 212 and the transmitter 214 can transmit processed audio from the microphone device 105 to hearing devices or another electronic device. The transmitter 214 can be configured to transmit processed audio using a wireless protocol or by broadcasting (e.g., sending the processed audio as a broadcast signal). The transmitter 214 can communicate using Bluetooth™ (e.g., Bluetooth Classic™, Bluetooth Low Energy™), ZigBee™, Wi-Fi™, other 802.11 wireless communication protocol, or a proprietary communication protocol. Although the processor 212 and the transmitter 214 are shown as separate units, the processor 212 and the transmitter 214 can be combined into a single unit or physically and electronically coupled together. In some implementations, the transmitter 214 has a single antenna and in other implementations, the transmitter 214 can have multiple antennas. The multiple antennas can be used for multiple-input multiple-output or to compute the virtual mark.

The processor 212 can include special-purpose hardware such as application specific integrated circuits (ASICs), programmable logic devices (PLDs), field-programmable gate arrays (FPGAs), programmable circuitry (e.g., one or more microprocessors microcontrollers), Digital Signal Processor (DSP), appropriately programmed with software and/or computer code, or a combination of special purpose hardware and programmable circuitry. In some implementations, the processor 212 includes multiple processors (e.g., two, three, or more) that can be physically coupled to the microphone device 105.

The processor 212 can also execute a generic HRTF operation or specific HRTF. For example, the processor 212 can be configured to access non-transitory memory storing instructions for executing the generic HRTF. The generic HRTF is a transfer function that characterizes how an ear receives audio from a point in space. The generic HRTF is based on an average or common HRTF for a person with average ears or an average head size (e.g., derived from a dataset of different individuals listening to sound. The generic HRTF is a time-invariant system with a transfer function H(f)=Output (f)/Input (f), where f is the frequency. The generic HRTF can be stored in a memory coupled to the processor 212. In some implementations, the processor 212 can executed a specific HRTF based on a received or downloaded HRTF function specific to a user (e.g., from a mobile application or computing device wirelessly).

The generic HRTF can include, adjust or account for several signal features such as simple amplitude adaptation, finite impulse response (FIR) and infinite impulse response (IIR) filters, gain, and delay applied in frequency domain in a filter bank to mimic or simulate the interaural level differences (ILD), interaural time differences (ITD) and other spectral cues (frequency response or shape) that are due to a user's body, head, or physical features (e.g., ears and torso).

The microphone device 105 can apply an HRTF and use information about the angle of the beams 225, the size of the beams, or characteristics of the beams. For the HRTF, the microphone device 105 can assume all the microphones are at the same height (i.e., there is no variation in elevation of the microphones 205). With such an assumption, the microphone device 105 can use an HRTF that assumes that all received audio originated from the same height or elevation.

As shown in FIG. 2A, the microphone device 105 can include a housing 220. The housing 220 can be comprised of a plastic, metal, combination of plastic and metal, or other material with favorable sound properties for microphones. The housing 220 can be used to hold or secure the microphones 205, the processor 212, and the transmitter 214 in place. The housing 220 can also make the microphone device 105 into a portable system such that it can be moved around by a human. In some implementations, the housing 220 can include the reference point 135 as a physical mark on the outside of the housing 220. It will be appreciated that the housing can have many different configurations such as open, partially open, or closed. Additionally, the microphones 205, the processor 212, the transmitter 214 can be coupled physically to the housing (e.g., with glue, screws, tongue and grooves, or other mechanical or chemical method).

Figure 2B:
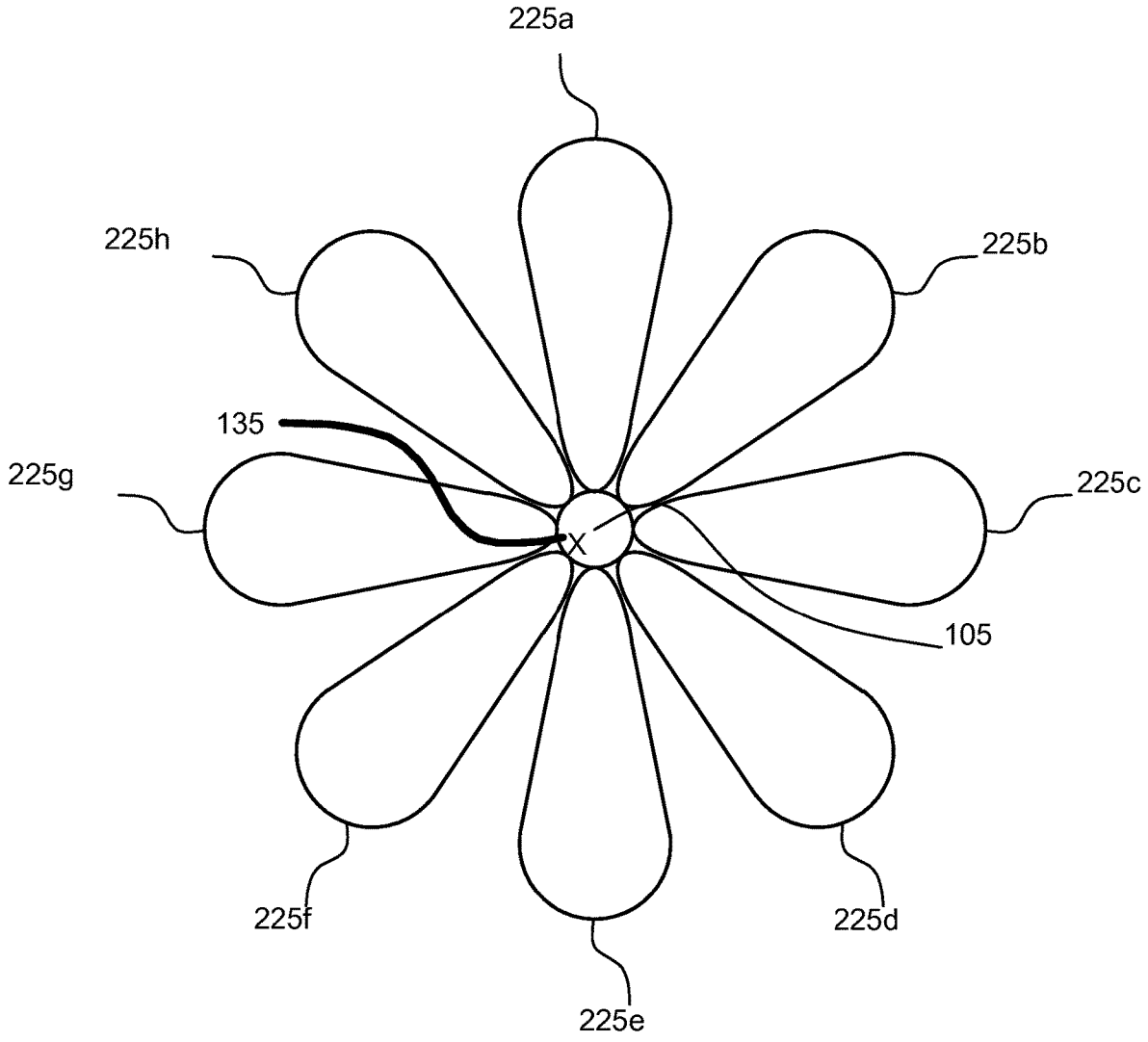
FIG. 2B illustrates a visual representation of beams formed from the microphone device in FIG. 2A in accordance with some implementations of the disclosed technology.
Figure 2C:
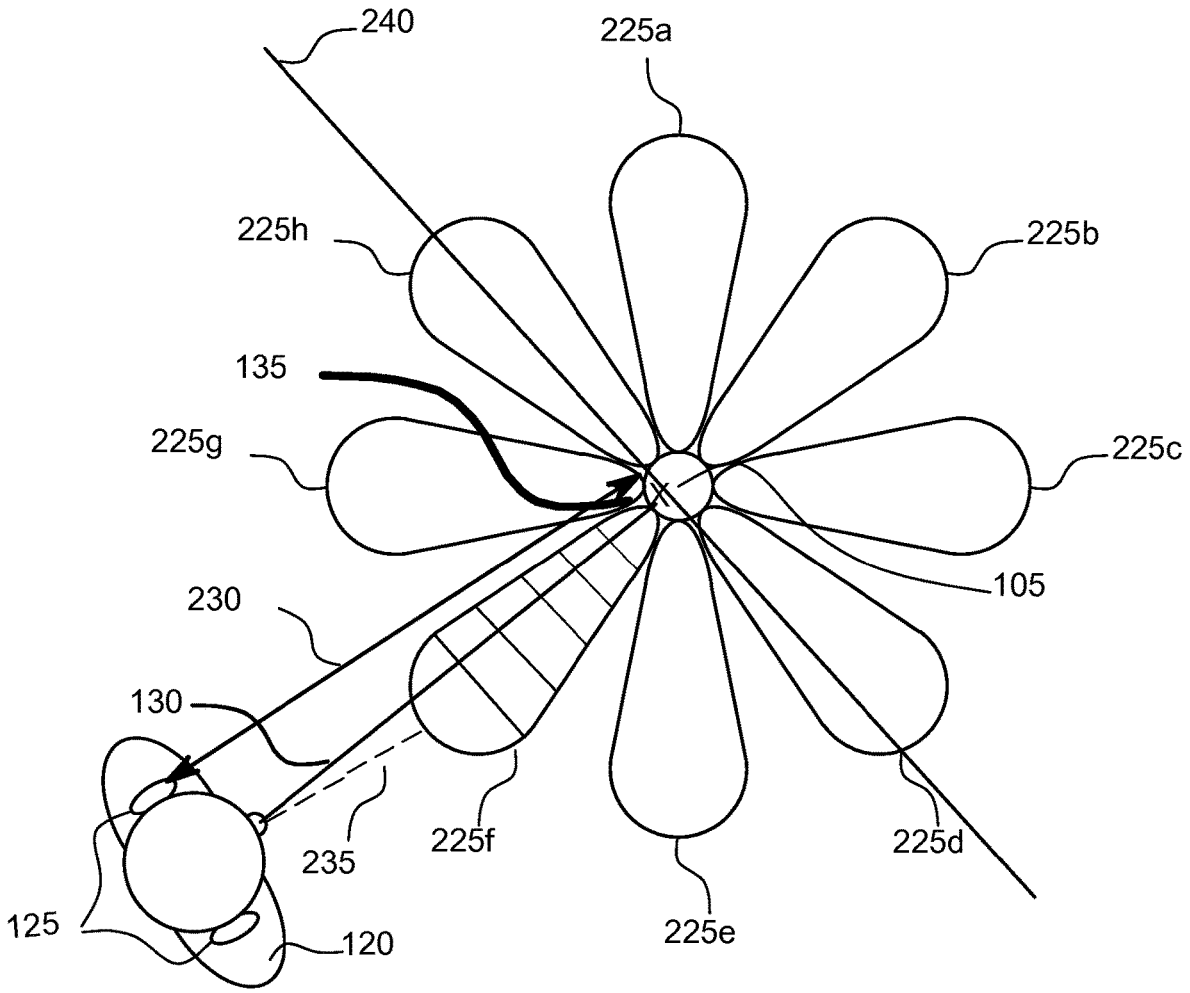
FIG. 2C illustrates a visual representation for using the microphone device from FIG. 2A to process sound received from the microphone device in FIG. 2A in accordance with implementations of the disclosed technology.

FIG. 2C illustrates a visual representation of beams formed from the microphone device 105. The microphone device 105 forms beams 225*a-h*, which are also referred to as "sound receiving beams" because these beams receive sound. In some implementations, the beams are similar size and shape, but each beam is oriented in a different direction. If there are 8 beams (as shown in FIG. 2C), a first beam can be configured to receive sound from 0 to 45 degrees (e.g., beam 225*a*), a second beam can be configured to receive sound from 46-90 degrees (e.g., beam 225*b*), third beam configured to receive sound from 91-135 degrees (e.g., beam 225*c*), a fourth beam configured to receive sound from 136-180 degrees (e.g., beam 225*d*), a fifth beam configured to receive sound from 181-225 (e.g., beam 225*e*), a sixth beam configured to receive sound from 226-270 (e.g., beam 225*e*), a seventh beam configured to receive sound from 271-315 degrees (e.g., beam 225*f*), and an eighth beam configured to receive sound from 315-360 degrees (e.g., beam 225*f*).

Although an 8 beam configuration is shown in FIG. 2C, the microphone device can generate different number of beams. For example, if there are 6 beams, a first beam can be configured to receive sound from 0 to 60 degrees, a second beam can be configured to receive sound from 61-120 degrees, third beam configured to receive sound from 121-180 degrees, a fourth beam configured to receive sound from 181-240 degrees, a fifth beam configured to receive sound from 241-300, and a sixth beam configured to receive sound from 301-360 degrees. More generally, a trade-off between complexity (e.g., number of microphones, signal processing) and spatial resolution (number of beams) exists and it can be beneficial to alter the complexity based on the situation (e.g., how many speakers or where the microphone will likely be used).

Although FIG. 2C visually shows some space between beams, the microphone device 105 can generate the beams such there is no space or even some overlapping between the beams. More specifically, the microphone device 105 can generate beams such that there is no "dead space" areas where a beam does not exist. The amount of overlap can be adjusted by the processor or an engineer designing the system. In some implementations, the beams may overlap by 1, 2, 3, 4, 5, 10, 15, or 20 percent. The processor can be configured to compute angle or sound arrival for overlapping beams with digital signal processing algorithms for beam forming. The microphone device 105 can also generate beams that extend away from the microphone device 105 continuously.

FIG. 2C also illustrates an orientation line 240. The orientation line 240 is an imaginary line that is perpendicular or generally perpendicular (e.g., within a few degrees) to the reference line 130. The orientation line 240 divides areas of the sound environment where the microphone device 105 is located into regions. For example, the orientation line 240 divides a "front region" from a "back region", where a front region refers to sounds coming from beams located to the left, right, or in front of a virtual listener 110 and the back region refers to sound coming from the back of the virtual listener 110 at the microphone device 105. The microphone device 105 can weigh sounds coming from the front, left, or right sides (e.g., from beams in those regions) more heavily than sounds coming from the back, back left, or back right (e.g., sound from behind the super imposed user). As an example in this configuration, the microphone device 105 could weigh sounds coming from speakers located to the front, left, and right of the microphone device 105 more than a user's own voice, which come from the back of the microphone device 105.

FIG. 2C also illustrates a visual representation of processing sound received from the microphone device based on using detection of a user's own voice. For example, one or both the hearing devices can include a first microphone adapted to be worn about the ear of the listener 120, a second microphone adapted to be worn about the ear canal of the listener 120 and at a different location than the first microphone, a processor adapted to process signals from the first or the second microphone to produce a processed sound signal, and a voice detector to detect the voice of the wearer. The voice detector includes an adaptive filter to receive signals from the first microphone and the second microphone, which can be used to detect a user's own voice.

As illustrated in FIG. 2C, the hearing device 125 can send a signal to microphone device 105, wherein the signal includes information regarding detecting or previously detecting a user's own voice at the microphone. In some implementations, the hearing device 125 can send information related to a user's voice fingerprint (e.g., characteristics of the voice such as amplitude and frequency) that can be used to identify the user's voice, which is illustrated as wireless communication link 230. When the microphone device 105 receives this information, it can store it in memory and use it to determine if it receives the user's voice (e.g., at beam or at a microphone) has been detected or captured. In some implementations, the microphone device 105 generates a voice fingerprint for the user (e.g., when the user sets up the microphone device) and then the microphone device 105 can determine when a user's own voice is detected by computing it locally at the microphone device 105.

As shown in FIG. 2C, the beam 225*f* has stripped lines to indicated that a user is speaking and the user's voice is captured by the beam 225*f*. The dashed line 235 between the listener 120 illustrates a path that sound from the user's voice to the beam 225*f* can take. The microphone device 105 can use the detection of a user's own voice in addition to receipt of a signal that a user's own voice has been detected to weight or process received sound.

Figure 3:
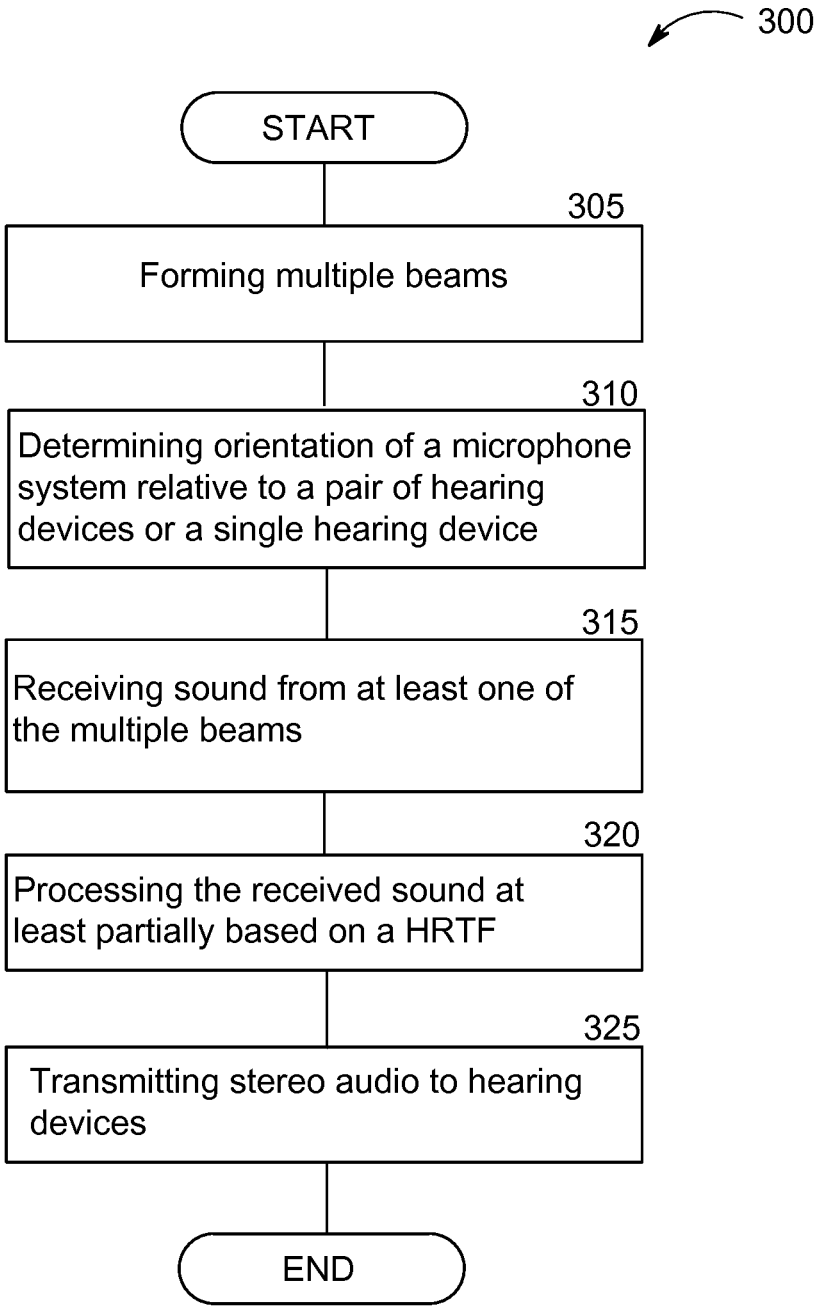
FIG. 3 is a block flow diagram for receiving sound, processing sound to generate processed audio, and transmitting the processed audio in accordance with some implementations of the disclosed technology.

FIG. 3 is a block process flow diagram for receiving sound, processing the sound to generate processed audio, and transmitting the processed audio as a wireless stereo audio signal to hearing devices, where the wireless stereo audio signal includes spatial cues because the sound was processed by an HRTF with beams with a known orientation. The process 300 can begin when a user of the microphone device places the microphone device on a table or in a conference room. The microphone device can be a conference table microphone device where the table microphone is configured to transmit processed audio to hearing devices. The process 300 can be triggered to start automatically once the microphone device 105 is turned on or it can be trigged manually when a user turns on his or her hearing devices or pushes a user control button on the microphone device to start the process 300.

At beam forming operation 305, the microphone device forms one or more beams. For example, the microphone device 105 can form 2, 3, 4, 5, 6, 7, 8, 9, 10, 11, or 12 beams Each beam can be configured to capture sound from a different direction. For example, if there are 6 beams, a first beam can be configured to receive audio from 0 to 60 degrees, a second beam can be configured to receive audio from 61-120 degrees, third beam configured to receive sound from 121-180 degrees, a fourth beam configured to receive sound from 181-240 degrees, a fifth beam configured to receive sound from 241-300, and a sixth beam configured to receive sound from 301-360 degrees. A processor (e.g., processor 212 from FIG. 2B) can form the beams with the microphones based on digital signal processing techniques or directional microphones as described in FIG. 2B. The beams can have some overlap as described in FIG. 2C. In some implementations, it may be beneficial to form 6 beams because the microphone device is placed at table where speakers are sitting in locations that correspond to the 6 beams.

At determining position operation 310, the microphone device determines the position of the reference point relative to received sound at the beams. In some implementations, the microphone device determines the position of the reference point relative to received sound at the beams based on a physical mark or virtual mark (reference point 135). To perform the determining position operation 310, a user can place the microphone device on a table and calibrate or align the microphone device such that he or she faces the microphone device, where facing means the user is oriented with his or her front towards the reference point 135 such that the reference line 130 can appear (virtually) between the microphone device and the user. This calibration or alignment can be referred to as the listener "positioning" the reference point relative to the user. For example, the listener can position a physical mark (e.g., the reference point 135) of the microphone device such that the listener is facing the mark and looking at the physical mark. In some operations, the determine operation 310 is a preliminary step that occurs before beamforming.

As another example of the determining position operation 310, the microphone device 105 can use accelerators, gyroscope, or another motion sensor to form an inertial navigation system to determine where the microphone device was placed relative to a user wearing the hearing devices. The microphone device 105 can determine a position and orientation based on a trigger (e.g. turning on the device) at the hearing impaired user's sitting position and subsequently measuring acceleration and other parameters.

At receiving operation 315, the microphone device receives sound from one or all the multiple beams. For example, as shown in FIG. 2C the microphone can receive sound from one or all the beams 225*a-h*. The microphone device 105 can determine the position of the received sound in each beam based on the reference point 135. For example, the microphone can determine that sound was received in beam 225*a*, and beam 225*a* can have a position relative to the reference point 135 (e.g., to the left and up or coordinates (x, y)).

At processing operation 320, the microphone device 105 processes the received sound using an HRTF (e.g., a specific or generic HRTF). The HRTF can modify the received audio to adjust amplitude, phase, or the output processed audio that will be transmitted to the user, where the user is wearing the hearing devices 125. The generic HRTF can also use the reference point 135 to process received sound according to location of the virtual listener 110. The virtual listener 110 is also referred to as a "superimposed" wearer of the hearing devices 125 because the listener 120 is superimposed on the microphone device 105 with respect to the reference point 135. For example, based on superimposing the listener 120 as a virtual listener 110, the microphone device can determine what is considered the "left", "right", "front", and "back side" of the virtual listener 110. The microphone device can weigh signals received from beams located in the "left", "right", "front", and "back side". Also, each beam in the microphone device 105 will have a known orientation based on the reference point 135.

The generic HRTF can use the coordinates of the beam, angle of the beam, and which beam receive the sound to process the received sound according to generic HRTF. During the processor operation 320, the processor 212 can read memory that stores information about the coordinates of the reference point 135 relative to the beams 225 and based on this information, the processor 212 can determine the orientation of received sound relative to the reference point 135 and the beams 225. In some implementations, based on an azimuth angle (phi) determined by the processor 212 in the receiving operation 315, the microphone device 105 applies an HRTF with a constant elevation angle (theta), which assumes all the microphones at the same elevation.

In the processing operation 320, the microphone device can also generate a multichannel output signal, where each channel refers to or includes different spatial information for the processed sound such that listener wearing the hearing devices receiving the sound can hear sound with spatial context.

At transmitting operation 325, the microphone device transmits the processed audio as an output processed audio signal (e.g., stereo audio signal) to the hearing devices 125. For example, the microphone device 105 can transmit stereo audio to the listener 120 (FIG. 1), who is wearing a left and right hearing device 125 (FIG. 1).

After the transmitting operation 325, the process 300 can stop, be repeated, or repeated one or all the operations. In some implementations, the process 300 continues if the microphone device 105 is on or detects sound. In some implementations, the process 300 occurs continuously while sound is received (or sound above a certain threshold such as the noise floor). Additionally, the determining position operation 310 can be repeated if the listener moves or the microphone device 105 moves. In some implementations, the hearing devices 125 can further process the received stereo audio signal (e.g., apply gain, filter further, or compress) or the hearing devices can provide only the stereo audio signal to the listener, who is wearing the hearing devices.

Figure 4:
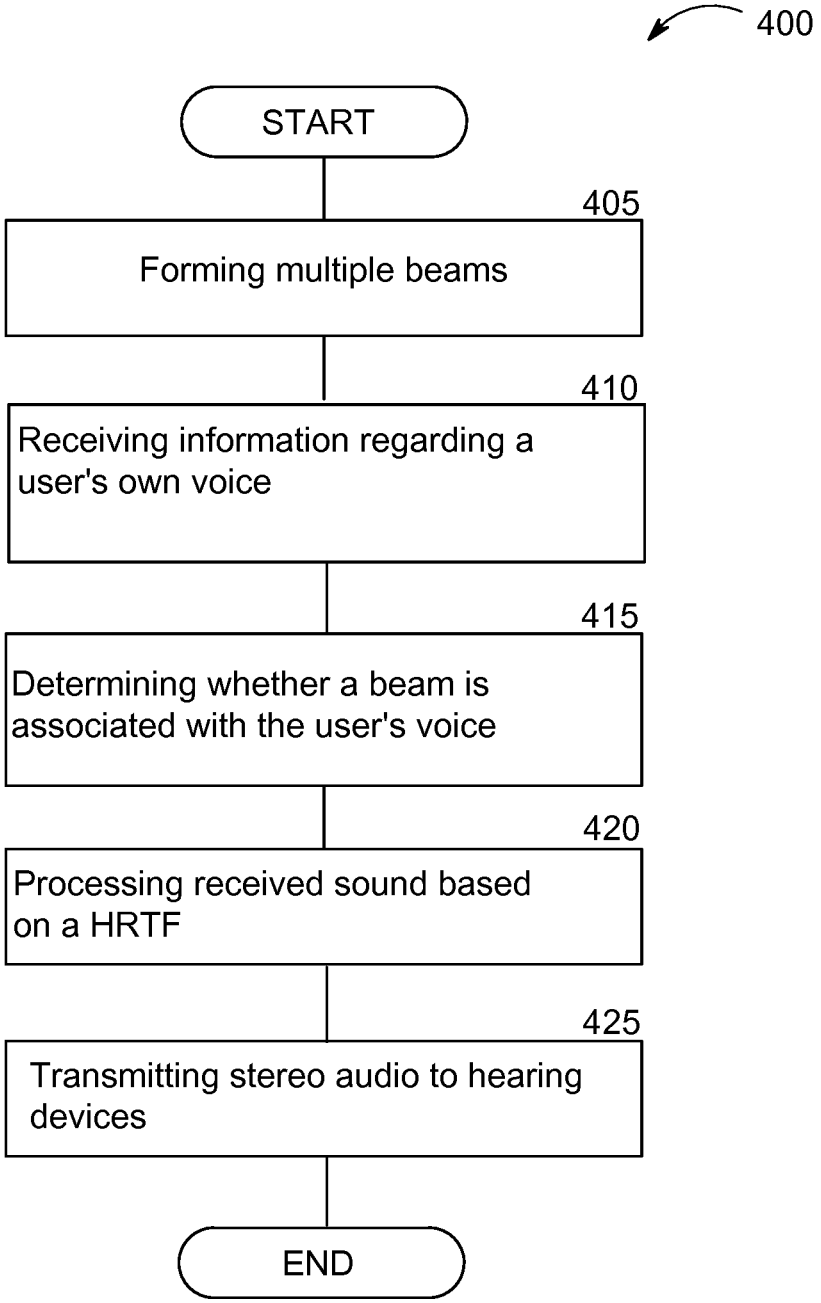
FIG. 4 is a block flow diagram for receiving sound, processing sound to generate processed audio, and transmitting the processed audio based on information about a user's own voice in accordance with some implementations of the disclosed technology.

FIG. 4 is a block process flow diagram for receiving sound, determining a location of the reference point based on own voice information, processing the sound to generate processed audio, and transmitting the processed audio as a wireless stereo audio signal to hearing devices. The process 400 can be triggered to start automatically once the microphone device 105 is turned on or it can be trigged manually when a user turns on his or her hearing devices or pushes a user control button on the microphone device to start the process 400.

At beam forming operation 405, the microphone device forms one or more beams. For example, the microphone device 105 can form 2, 3, 4, 5, 6, 7, 8, 9, 10, 11, or 12 beams (FIG. 1, FIG. 2B). Each beam can be configured to capture sound from a different direction. For example, if there are 6 beams, a first beam can be configured to receive audio from 0 to 60 degrees, a second beam can be configured to receive audio from 61-120 degrees, third beam configured to receive sound from 121-180 degrees, a fourth beam configured to receive sound from 181-240 degrees, a fifth beam configured to receive sound from 241-300, and a sixth beam configured to receive sound from 301-360 degrees. In some implementations, it may be beneficial to form 6 beams because the microphone device is placed at table where speakers are sitting in locations that correspond to the 6 beams.

At receiving an own voice signal operation 410, the microphone device 105 receives information regarding a user's own voice. In some implementations, the hearing device 125 detects a user's own voice and transmits a signal to the microphone device 105 indicating that a user is currently speaking. Alternatively, the hearing device can transmit a voice fingerprint of the user's own voice to the microphone device, where the voice fingerprint can be transmitted before using the microphone device and the microphone device can store the voice fingerprint. The voice fingerprint can contain information (e.g., features of a user's voice) that can be used by the microphone device to detect a user's own voice. Another alternative is that the user speaks to the microphone device and the microphone device stores a voice fingerprint of the user's voice locally. Even another alternative is that the microphone device has already received the voice fingerprint (e.g., over the internet).

At determining operation 415, the microphone device uses own voice information to determine a location of the reference point. In some implementations of the determining operation 415, the microphone device determines that a user's own voice has been detected in a beam, which enables the microphone device to determine which beam a user is speaking into versus other beams orientated in a different direction or inactive beams. The selected beam can be an assumed location of the user and the reference point location can be determined from a reference line (FIG. 2C). In some implementations, the microphone device can determine that it is concurrently receiving a signal from the hearing device that indicates an own voice is detected and sound in a beam, assuming the sound in the beam is the user's voice, the microphone device can determine which beam a user is speaking into versus other beams orientated in a different direction or inactive beams.

At processing operation 420, the microphone device processes the received sound using an HRTF (e.g., specific or generic). The generic HRTF can modify the received audio to adjust amplitude, phase, or the output processed audio that will be transmitted to the user, where the user is wearing hearing devices 125. The generic HRTF can also use the determined beam from determining operation 415 to determine where a user is located relative to other beams and where a user's voice is coming from, e.g., the direction of arrival and a beam's associated orientation. Also, each beam in the microphone device 105 has a known orientation and the microphone device 105 can determine a location of a reference point based on a reference line.

In some implementations, the processor can apply the HRTF to each beam individually such that the processed audio is associated with spatial information or spatial cues such as sound came from the front of the microphone device, back of the microphone device, or side of the microphone device. In some implementations, based on the azimuth angle (phi), the microphone device applies an HRTF with a constant elevation angle (theta), equal to 0 degrees into a far-field HRTF transfer function H (f, theta=0 degrees, phi). Also, in the processing operation 320, the microphone device can generate a multi-channel output audio signal (e.g., a stereo audio signal with a left and right signal based on the generic HRTF).

At transmitting operation 425, the microphone device 105 transmits a multi-channel signal to the hearing devices. For example, the microphone device can be the microphone device 105 transmitting stereo audio to the listener 120 (FIG. 1), who is wearing a left and right hearing device 125 (FIG. 1).

After the transmitting operation 425, the process 400 can stop, be repeated, or repeated one or all the operations. In some implementations, the process 400 continues if the microphone device 105 is on or detects sound or an own voice signal. In some implementations, the process 400 occurs continuously while sound is received (or sound above a certain threshold such as above the noise floor). Additionally, in some implementations, the determining operation 415 can be repeated if the listener moves or the microphone device 105 moves. In some implementations, the hearing devices can further process the received stereo audio signal (e.g., apply gain, filter further, or compress) or the hearing devices can simply provide the stereo audio signal to the hearing devices. In some implementations, the microphone device 105 can update a user's voice fingerprint or store voice fingerprints for multiple users.

CONCLUSION

Unless the context clearly requires otherwise, throughout the description and the claims, the words "comprise," "comprising," and the like are to be construed in an inclusive sense, as opposed to an exclusive or exhaustive sense; in the sense of "including, but not limited to." As used herein, the terms "connected," "coupled," or any variant thereof means any connection or coupling, either direct or indirect, between two or more elements; the coupling or connection between the elements can be physical, logical, electronic, magnetic, electromagnetic, or a combination thereof. Additionally, the words "above," and "below," and words of similar import, when used in this application, refer to this application and not to any portions of this application. Where the context permits, words in the above Detailed Description using the singular or plural number may also include the plural or singular number respectively. The word "or," in reference to a list of two or more items, covers all the following interpretations of the word: any of the items in the list, all the items in the list, any combination of the items in the list, or a single item from the list.

The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements. For example, the microphone device can transmit stereo audio signals to hearing devices intended to be used for hearing impaired individuals or to hearing device configured for non-hearing-impaired individuals.

The terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim.

The techniques, algorithms, and operations introduced here can be embodied as special-purpose hardware (e.g., circuitry), as programmable circuitry appropriately programmed with software and/or firmware or computer code, or as a combination of special-purpose and programmable circuitry. Hence, embodiments may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, read-only memories (ROMs), random access memories (RAMs), erasable programmable read-only memories (EPROMs), electrically erasable programmable read-only memories (EEPROMs), magnetic or optical cards, flash memory, or other type of media such as machine-readable medium suitable for storing electronic instructions. The machine-readable medium includes non-transitory medium, where non-transitory excludes propagation signals. For example, the processor 212 can be connected to a non-transitory computer-readable medium that stores instructions for executing instructions by the processor such as instructions to form a beam or carry out a generic or specific head transfer function. As another example, the processor 212 can be configured to use a non-transitory computer-readable medium storing instructions to execute the operations described in the process 300 or the process 400. Stored instructions can also be referred to as a "computer program" or computer software."

What is claimed:

1. A microphone device comprising:

a first and second microphone configured to individually or in combination form a sound receiving beam or beams;

a processor electronically coupled to the first and second microphones, the processor configured to apply a digital signal processing algorithm to received sound at the sound receiving beam or beams based on an orientation of the sound receiving beam or beams based on a reference point to generate a multichannel output audio signal; and a transmitter configured to transmit the multichannel output audio signal generated by the processor, wherein the reference point is associated with a location on the microphone device, wherein the microphone device is configured to determine a location of the reference point based on an own voice detection signal received from a hearing device and one of the sound receiving beams receiving sound.

2. The microphone device of claim 1, wherein the multichannel output audio signal is transmitted to hearing devices, wherein a wearer of the hearing devices positioned the reference point relative to the wearer, and wherein the reference point is associated with a virtual listener.

3. The microphone device of claim 2, wherein the processor weighs the received sound from a front, left, or right side of the virtual listener more than other received sound from the back of the virtual listener on the microphone device.

4. The microphone device of claim 1, wherein the multichannel output audio signal is a stereo signal.

5. The microphone device of claim 1, further comprising: a third microphone configured to individually or in combination with the first and second microphone form the beam or beams.

6. The microphone device of claim 5, wherein the first, second, and third microphone have an equal spacing distance between each other.

7. The microphone device of claim 1, wherein the reference point is a physical mark on the microphone device or the reference point is a virtual mark associated with a location on the microphone device.

8. The microphone device of claim 1, wherein the reference point is a physical mark on the microphone device located on a side of the microphone device, and wherein the physical mark is visible.

9. The microphone device of claim 1, wherein the first and second microphones are directional microphones or wherein the first and second microphones and the processor in combination are configured to form the sound receiving beam or beams.

10. The microphone device of claim 1, wherein the digital signal processing algorithm is a generic HRTF or a specific HRTF, wherein the specific HRTF is associated with a head of a wearer of the hearing devices.

11. The microphone device of claim 1, wherein the microphone device is configured to determine the reference point based on receiving characteristics of a wearer's own voice from a hearing device and configured to use those characteristics to determine whether the wearer's own voice is detected at one of the sound receiving beam or beams.

12. The microphone device of claim 1, wherein the microphone device is configured to determine a location of the reference point based on a voice fingerprint of a wearer's own voice that is stored on the microphone device.

13. A microphone device comprising:

a first and second microphone configured to individually or in combination form a sound receiving beam or beams;

a processor electronically coupled to the first and second microphones, the processor configured to apply a digital signal processing algorithm to received sound at the sound receiving beam or beams based on an orientation of the sound receiving beam or beams based on a reference point to generate a multichannel output audio signal; and a transmitter configured to transmit the multichannel output audio signal generated by the processor, wherein the reference point is associated with a location on the microphone device, wherein the microphone device is configured to determine a location of the reference point based on receiving an own voice detection signal received from a hearing device, receive sound at one of the sound receiving beams, generate a voice fingerprint of a wearer's own voice from the receiving sound at the microphone device, and to determine that the wearer's own voice is detected at one of the sound receiving beams based on the generated voice fingerprint.

14. A method for using a microphone device, the method comprising: forming, by the microphone device, sound receiving beams, wherein each of the sound receiving beams is configured to receive sound arriving from a different direction;

processing, by the microphone device, received sound from one of the sound receiving beams based on a digital signal processing algorithm and a reference point to generate a multichannel output audio signal;

determining a location of the reference point based on receiving an own voice detection signal received from one of the hearing devices and the microphone device detecting sound in one of the sound receiving beams; and transmitting the multichannel output audio signal to hearing devices.

15. The method of claim 14, wherein a wearer of the hearing devices positioned the reference point relative to the wearer.

16. A method for using a microphone device, the method comprising: forming, by the microphone device, sound receiving beams, wherein each of the sound receiving beams is configured to receive sound arriving from a different direction;

processing, by the microphone device, received sound from one of the sound receiving beams based on a digital signal processing algorithm and a reference point to generate a multichannel output audio signal;

determining a location of the reference point based on receiving detected characteristics of a wearer's own voice from one of the hearing devices and determining whether a wearer's own voice is detected at one of the sound receiving beams based on the detected characteristics; and transmitting the multichannel output audio signal to hearing devices.

17. A method for using a microphone device, the method comprising: forming, by the microphone device, sound receiving beams, wherein each of the sound receiving beams is configured to receive sound arriving from a different direction;

processing, by the microphone device, received sound from one of the sound receiving beams based on a digital signal processing algorithm and a reference point to generate a multichannel output audio signal;

determining a location of the reference point based on receiving an own voice detection signal received from one of the hearing devices;

receiving sound at one of the sound receiving beams; generating a voice fingerprint of a wearer's own voice from the receiving sound at the microphone device;

determining that the wearer's own voice is detected at one of the sound receiving beams based on the generated voice fingerprint; and transmitting the multichannel output audio signal to hearing devices.

18. The method of claim 14, wherein processing the received sound further comprises:

determining a location of the reference point based on a voice fingerprint of a wearer's own voice that is stored on the microphone device.

19. The method of claim 14, wherein the digital signal processing algorithm is a generic HRTF or a specific HRTF, wherein the specific HRTF is associated with a head of a wearer of the hearing devices.

20. A non-transitory computer-readable medium storing instructions, which when executed by a processor, that cause a microphone device to perform operations, the operations comprising:

forming, by the microphone device, sound receiving beams, wherein each of the sound receiving beams is configured to receive sound arriving from a different direction;

processing, by the microphone device, received sound from one of the sound receiving beams based on a digital signal processing algorithm and a reference point to generate a multichannel output audio signal;

determining a location of the reference point based on receiving an own voice detection signal received from one of the hearing devices and the microphone device detecting sound in one the sound receiving beams; and transmitting the multichannel output audio signal to hearing devices.

21. The non-transitory computer-readable medium of claim 20, wherein a wearer of the hearing devices positioned the reference point relative to the wearer.

22. A non-transitory computer-readable medium storing instructions, which when executed by a processor, that cause a microphone device to perform operations, the operations comprising:

forming, by the microphone device, sound receiving beams, wherein each of the sound receiving beams is configured to receive sound arriving from a different direction;

processing, by the microphone device, received sound from one of the sound receiving beams based on a digital signal processing algorithm and a reference point to generate a multichannel output audio signal;

determining a location of the reference point based on receiving detected characteristics of a wearer's own voice from one of the hearing devices and determining whether a wearer's own voice is detected at one of the sound receiving beams based on the detected characteristics; and transmitting the multichannel output audio signal to hearing devices.

23. The non-transitory computer-readable medium of claim 20, wherein processing the received sound further comprises:

determining a location of the reference point based on receiving an own voice detection signal received from one of the hearing devices;

receiving sound at one of the sound receiving beams; generating a voice fingerprint of a wearer's own voice from the receiving sound at the microphone device; and determining that the wearer's own voice is detected at one of the sound receiving beams based on the generated voice fingerprint.

24. The non-transitory computer-readable medium of claim 20, wherein processing the received sound further comprises:

determining a location of the reference point based on a voice fingerprint of a wearer's own voice that is stored on the microphone device.

25. The non-transitory computer-readable medium of claim 20, wherein the digital signal processing algorithm is a generic HRTF or a specific HRTF, wherein the specific HRTF is associated with a head of a wearer of the hearing devices.

* * * * *